US005173973A

United States Patent [19]

Mersmann

[11] Patent Number: 5,173,973

[45] Date of Patent: Dec. 29, 1992

[54] WHIRLPOOL BATHTUB

[75] Inventor: Heinz-Werner Mersmann, Ahlen, Fed. Rep. of Germany

[73] Assignee: Franz-Dieter Kaldewei, Fed. Rep. of Germany

[21] Appl. No.: 786,117

[22] Filed: Nov. 1, 1991

[30] Foreign Application Priority Data

Nov. 5, 1990 [DE] Fed. Rep. of Germany ..... 4035074

[51] Int. Cl.[5] ..... A47K 3/00; E03C 1/232

[52] U.S. Cl. ..... 4/541.1; 4/559; 4/682

[58] Field of Search ..... 4/541.1, 541.3, 541.4, 4/541.5, 546, 559, 679, 680, 682, 683, 687, 694

[56] References Cited

U.S. PATENT DOCUMENTS

| | | | |
|---|---|---|---|
| 1,744,105 | 1/1930 | Clow et al. | 4/683 |
| 2,587,335 | 2/1952 | Landergott | 4/541.4 |
| 3,271,790 | 9/1966 | Schneider et al. | 4/541.4 |
| 3,391,411 | 7/1968 | Miller, Jr. | 4/541.3 X |
| 4,194,251 | 3/1980 | Pennerstorfer | 4/682 X |
| 4,233,694 | 11/1980 | Janosko et al. | 4/541.3 |
| 4,424,438 | 1/1984 | Antelman et al. | 4/559 X |
| 4,594,738 | 6/1986 | Gebert | 4/680 |
| 5,117,233 | 5/1992 | Hamos et al. | 4/541.1 X |

FOREIGN PATENT DOCUMENTS

| | | | |
|---|---|---|---|
| 0286941 | 10/1988 | European Pat. Off. . | |
| 0421520 | 4/1991 | European Pat. Off. | 4/541.1 |
| 3110151 | 9/1982 | Fed. Rep. of Germany . | |
| 3334010 | 4/1985 | Fed. Rep. of Germany . | |
| 3507472 | 9/1986 | Fed. Rep. of Germany | 4/541.1 |
| 3703273 | 8/1988 | Fed. Rep. of Germany . | |
| 3738543 | 8/1988 | Fed. Rep. of Germany . | |

*Primary Examiner*—Henry J. Recla
*Assistant Examiner*—Robert M. Fetsuga
*Attorney, Agent, or Firm*—Speckman & Pauley

[57] ABSTRACT

A whirlpool bathtub with a wireless remote control comprising a mobile transmitter separate from the whirlpool installation and a receiver affixed to the bathtub for controlling the aspiration pump and/or the blower of the whirlpool installation. The receiver is affixed to the bathtub, independent of the installation or positioning of the bathtub in the bathroom, in accordance with this disclosure where the bathtub has an overflow device provided with a control knob and an overflow housing, for operating a drain device. The control knob is fixed against rotation on a hollow shaft which extends out of the overflow housing on the exterior of the bathtub. The control knob has a chamber, accessible to the control commands of a transmitter, into which the receiver is inserted. The connecting cable for the receiver is inserted through the hollow shaft and is connected to the receiver.

12 Claims, 1 Drawing Sheet

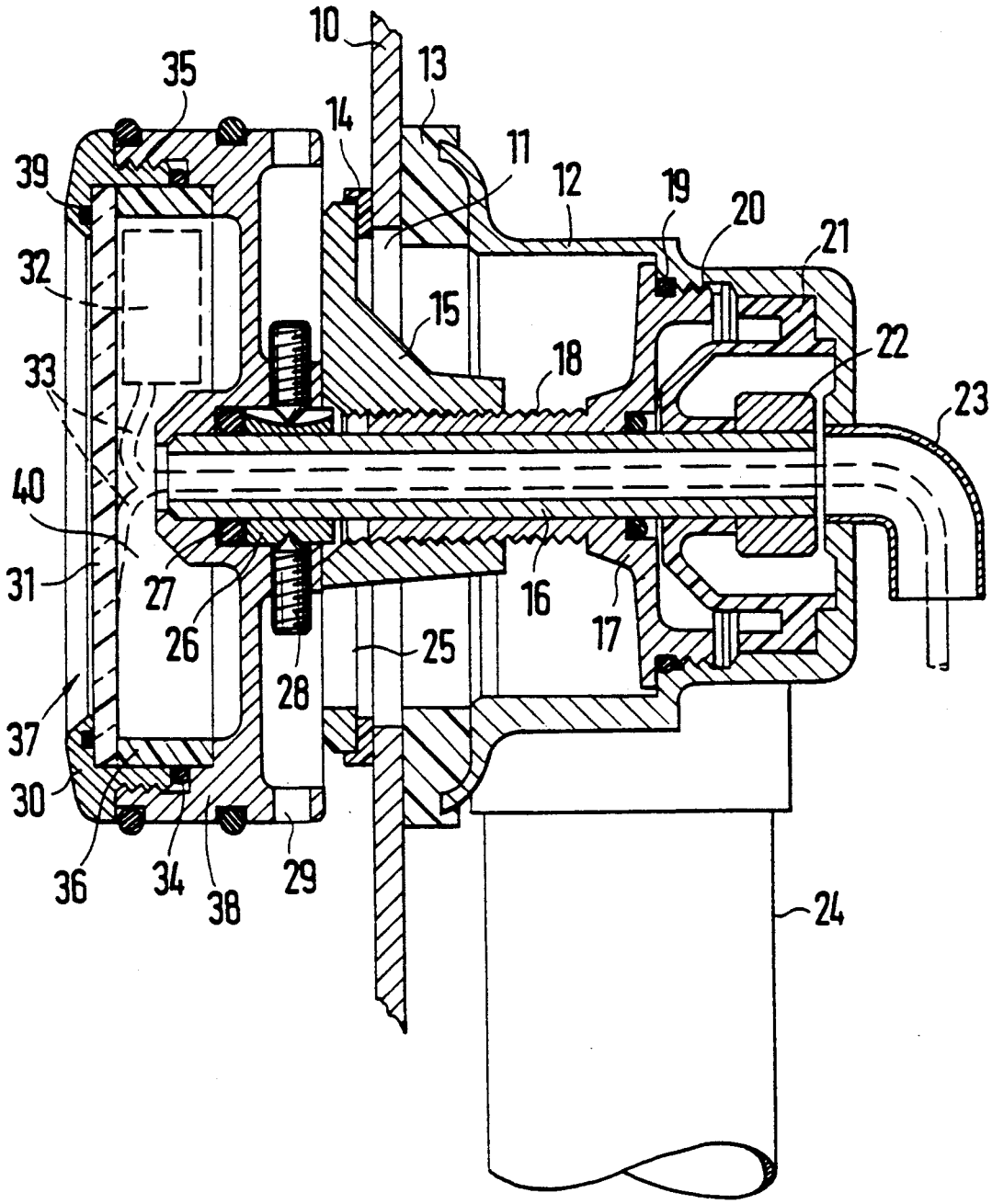
10
13
35
14
11
12
19
20
21
39
32
15
18
22
33
23
40
31
27
26
16
17
25
28
37
30
36
34
38
29
24

WHIRLPOOL BATHTUB

BACKGROUND OF THE INVENTION

1. Field of the Invention

This invention relates to a whirlpool bathtub having a wireless remote control comprising a mobile transmitter separate from the whirlpool installation and a receiver affixed to the bathtub for controlling the aspiration pump and/or the blower of the whirlpool installation.

2. Description of the Prior Art

In a whirlpool installation having a wireless remote control, the bather can operate and control the whirlpool installation using a mobile transmitter without having to leave the bathtub, so that he can even maintain the massage position in the bathtub. In a known whirlpool bathtub of this type, the receiver with operating elements and display elements is fastened to the rim of the bathtub. As a result, it is possible to operate and control the whirlpool installation directly from the control device. However, positioning of the control device on the rim of the bathtub has the disadvantage of being dependent on the installation and the position of the bathtub in the bathroom. As a result, the point at which the control device is affixed changes and requires individual adaptation. Furthermore, affixing the control device in this manner is not optimal from a design viewpoint.

German Patent Publication DE 37 03 273 teaches a device for the control of the air supply to the jets and for starting and stopping a pump in a bathtub whirlpool installation, in which a manually adjustable regulating member is used, which can be axially displaced and turned in a housing, performing the individual control functions. Operation is effected by a control knob which extends beyond the tub rim of the bathtub, where the device is installed in a hole in the tub rim.

European Patent publication EP 0 286 941 A1 discloses a bathtub whirlpool device with remote control. The remote control is separate from the central control device, which is disposed under or next to the bathtub. When using the remote control in the bathtub, the remote control device must be enclosed in a waterproof enclosure, such as is taught by German Patent Publication DE 37 38 543 A1.

A water drain valve with valve housing having a valve cone which can be lifted and lowered is taught by German Patent publication DE 31 10 151 A1. The overflow device of the bathtub has a rotatable element which operates a slide on the valve housing using a Bowden cable. The slide is connected by a lever arm to the operating lever of the valve cone.

As disclosed by German Patent Publication DE 33 34 010 A1, it is also possible to operate a plurality of drain valves by a rotating handle device using Bowden cables. In this case the rotating handle device is separate from the drain valves and is disposed at a distance from them.

SUMMARY OF THE INVENTION

It is an object of this invention to provide a remote controlled whirlpool bathtub in which the receiver for the remote control can be connected to the bathtub independent of the installation and position of the bathtub in the bathroom and integrated into the bathtub in an aesthetically optimal manner.

This object is attained in accordance with one embodiment of this invention wherein the bathtub has an overflow device with a control knob and an overflow housing for operating a drain device. The control knob is fixed against rotation on a hollow shaft which extends out of the overflow housing on the exterior of the bathtub. The control knob has a chamber, accessible to the control commands of the transmitter, adapted to receive the receiver. The connecting cable for the receiver is inserted through the hollow shaft and connected to the receiver.

In this embodiment of this invention, the receiver for the remote control is installed in the overflow device and therefore, is always in the same position, regardless of the installation and positioning of the bathtub in the bathroom. Thus, the whirlpool bathtub installation and positioning is independent of the positioning of the remote control device as the mobile transmitter need only transmit the control commands to the transmitter housed in the chamber of the control knob. The hollow shaft permits the connection of the receiver and its combination with the devices of the whirlpool installation, which are disposed underneath the built-in bathtub or on the outside of the bathtub.

In accordance with a preferred embodiment of this invention, the remote control has an infrared transmitter and an infrared receiver, and the chamber of the control knob is closed off in the direction of the inside of the bathtub by a foil touch-key with an infrared window in front of the infrared receiver. The foil touch-key permits additional direct operation of the whirlpool installation in the area of the overflow device. For displaying the operational state of the whirlpool installation, the foil touch-key is provided with display elements outside of the key area.

In accordance with another embodiment of this invention, the control knob is closed off by a screwed-on cap which is provided with a cut-out. The foil touch-key with the infrared window is inserted into the cut-out and the chamber for the receiver is formed between the foil touch-key and the control knob.

Fastening of the control knob on the hollow shaft and the connection between the control knob and the cap with the foil touch-key are provided in accordance with another embodiment of this invention in which the control knob has a bearing sleeve which is fixed on the hollow shaft of a clamping ring and threaded pins. The control knob has a peripheral annular collar provided with an interior thread, and the cap is provided with an exterior thread and can be screwed to the control knob.

In accordance with another embodiment of this invention, the cap extends over the periphery of the foil touch-key. The foil touch-key is supported by a support ring inside the annular collar on the disk-shaped control knob and, together with the control knob, forms the chamber for the infrared receiver. The cap is screwed on the control knob until the support ring limits the screw-on movement.

Sealed housing of the receiver is assured in that the foil touch-key is sealed towards the cap and the cap towards the control knob by sealing rings.

The invention will be described in detail in conjunction with one embodiment of this invention shown in the drawings. An illustration of the mobile transmitter and the apparatus of the whirlpool installation controlled by the receiver and the foil touch-key has been omitted, because they can be designed or controlled in a known manner.

BRIEF DESCRIPTION OF THE DRAWINGS

The single figure shows a sectional view of a remote control device for a whirlpool bathtub in accordance with one embodiment of this invention.

DESCRIPTION OF PREFERRED EMBODIMENT

The figure shows an overflow device installed in a known manner in the hole 11 in the tub wall 10. This overflow device has a cap-like overflow housing 12, which is sealingly supported around the hole 11 by the sealing element 13 on the outside of the bathtub. The shaft bearing 17 is screwed into the overflow housing 12, as shown by the threaded connection 20. The sealing ring 19 seals this connection point. The shaft bearing 17 fixes the bearing shell 21 for the hollow shaft 16 inside the overflow housing 12. The hollow shaft 16 is sealed towards the shaft bearing 17 by a sealing ring.

The hollow shaft 16 supports the Bowden cable catch 22, which is connected with the Bowden cable leading to the drain device, in the area of the bearing shell 21. The angled connection 23 is fastened on the bottom of the overflow housing 12 and makes possible the insertion of the connecting cable 33 into the hollow shaft 16.

The screw piece 15 is screwed by its inner thread on the outer thread 18 of the shaft bearing 17. The screw piece 15 is supported by the support ring 14 around the hole on the inside of the tub wall 10 and leaves the overflow conduit open towards the overflow pipe 24 through the hole 25.

The control knob 38 is fastened, fixed against rotation, on the end of the hollow shaft 16 extending from the screw piece 15 by the clamping ring 26 and by two diametrically extending threaded pins 28, which are accessible through the bores 29 in the annular collar of the control knob 28. The sealing ring 27 seals this connecting point.

The control knob 38 is disk-shaped and peripherally ends in an annular collar, which extends in the direction towards the interior of the bathtub and has an inner thread. As shown by the threaded connection 35, the cap 30 is screwed together with the control knob 38 and the sealing ring 34 seals this connection. The cap 30 is provided with the cut-out 37, into which the foil touch-key 31 is inserted. The cap 30 extends over the periphery of the foil touch-key 31 and the sealing ring 39 seals the transition from the cap 30 to the foil touch-key 31. The foil touch-key 31 is supported by the support ring 36 on the disk- shaped control knob 38 inside the annular collar. In this way the support ring 36 assures that the cap 30 with the foil touch-key 31 can be screwed on only far enough to provide a sufficiently large chamber 40 for the receiver 3 between the control knob 38 and the foil touch-key 31. The connecting cable 33 connected to the receiver 32 is guided through the hollow shaft 16 and comes out of the overflow housing 12 through the angled connection 23, so that it can be attached to the apparatus of the whirlpool installation.

In accordance with a preferred embodiment of this invention in which infrared control is used, the foil touch-key 31 has an infrared window in front of the infrared receiver 32, which assures entry of the infrared rays into the chamber 40 and transmission to the infrared receiver 32. The infrared transmitter is aimed at this infrared window when control commands are to be transmitted.

The touch-key areas of the foil touch-key 31, which may be additionally provided with display elements, are also connected to the apparatus of the whirlpool installation through the connecting cable 33. By an appropriate design of the foil touch-key 31, the whirlpool installation can be operated and controlled directly with the foil touch-key 31, that is, completely without the infrared transmitter.

The receiver 32 is housed completely sealed in the overflow device and can be controlled by the foil touch-key 31 in the cap 30 of the control knob 38.

I claim:

1. In a whirlpool bathtub with a wireless remote control having a mobile transmitter separate from a whirlpool installation and a receiver affixed to the bathtub for controlling at least one of an aspiration pump and a blower of the whirlpool installation, the improvement comprising:

an overflow device in said bathtub having a control knob (38) rotatably mounted in an overflow housing (12), said control knob being connected to a drain device for device for operating the drain device, the control knob (38) being fixed against rotation on one end of a hollow shaft (16), the other end of said shaft extending out of the overflow housing (12) to an exterior of the bathtub, the control knob (38) having a chamber (40) therein accessible to control commands from said transmitter and adapted to receive the receiver (32), and a connecting cable (33) inserted through the hollow shaft (16) and connecting to the receiver (32) to at least one of the aspiration pump and the blower.

2. In a whirlpool bathtub in accordance with claim 1, wherein:

the transmitter and receiver comprise an infrared transmitter and an infrared receiver (32), and the chamber (40) of the control knob (38) is closed off in a direction toward an inside of the bathtub by a foil touch-key (31) having an infrared window in front of the infrared receiver (32).

3. In a whirlpool bathtub in accordance with claim 2, wherein:

the control knob (38) is closed off by a screwed-on cap (30) having a cut-out (37), a foil touch-key (31) having an infrared window is inserted into the out-out (37), and the chamber (40) is formed between the foil touch-key (31) and the control knob (38).

4. In a whirlpool bathtub in accordance with claim 3, wherein:

the control knob (38) has a bearing sleeve which is fixed on the hollow shaft (16) by a clamping ring (26) and threaded pins (28), the control knob (38) has a peripheral annular collar with an interior thread, and said screwed-on cap (30) is provided with an exterior thread and screwed together with the control knob (38).

5. In a whirlpool bathtub accordance with claim 4, wherein:

said cap (30) extends around a periphery of said foil touch-key (31), and the foil touch-key (31) is supported by a support ring (36) positioned inside the chamber (40).

6. In a whirlpool bathtub in accordance with claim 5, wherein:

said foil touch-key (31) is sealed towards the screwed-on cap (30) and the screwed-on cap (30) towards the control knob (38) by a plurality of sealing rings (39, 34).

7. A whirlpool bathtub in accordance with claim 6, wherein:

said foil touch-key (31) is provided with at least one display element.

8. In a whirlpool bathtub in accordance with claim 1, wherein:

the control knob (38) is closed off by a screwed-on cap (30) having a cut-out (37), a foil touch-key (31) having an infrared window is inserted into the cut-out (37), and the chamber (40) is formed between the foil touch-key (31) and the control knob (38).

9. In a whirlpool bathtub in accordance with claim 1, wherein:

the control knob (38) has a bearing sleeve which is fixed on the hollow shaft (16) by a clamping ring (26) and threaded pins (28), the control knob (38) has a peripheral annular collar with an interior thread, and a cap (30) is provided with an exterior thread and screwed together with the control knob (38).

10. In a whirlpool bathtub in accordance with claim 1, wherein:

a cap (30) extends around a periphery of a foil touch-key (31), the cap having a cut-out (37) to expose a portion of the touch-key and the foil touch-key (31) is supported by a support ring (36) positioned the chamber (40) inside and the cap (30) being connected to the control knob (38) such that the foil touch-key (31) together with the control knob (38) closes the chamber (40) for the receiver (32).

11. In a whirlpool bathtub in accordance with claim 1, wherein:

a foil touch-key (31) is sealed towards a cap (30) and the cap (30) towards the control knob (38) by a plurality of sealing rings (39, 34).

12. A whirlpool bathtub in accordance with claim 11, wherein:

said foil touch-key (31) is provided with at least one display element.

* * * * *